US009716338B2

(12) United States Patent
Brown

(10) Patent No.: US 9,716,338 B2
(45) Date of Patent: Jul. 25, 2017

(54) WATERPROOF SEPARABLE SWIVEL CONNECTOR

(71) Applicant: Aqua Products, Inc., Cedar Grove, NJ (US)

(72) Inventor: Keith Brown, Montclair, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 14/776,824

(22) PCT Filed: Mar. 12, 2014

(86) PCT No.: PCT/US2014/024277
§ 371 (c)(1),
(2) Date: Sep. 15, 2015

(87) PCT Pub. No.: WO2014/150807
PCT Pub. Date: Sep. 25, 2014

(65) Prior Publication Data

US 2016/0036161 A1 Feb. 4, 2016

Related U.S. Application Data

(63) Continuation of application No. 13/965,597, filed on Aug. 13, 2013, now Pat. No. 9,203,199.
(Continued)

(51) Int. Cl.
*H01R 13/52* (2006.01)
*H01R 39/64* (2006.01)
(Continued)

(52) U.S. Cl.
CPC ..... *H01R 13/5219* (2013.01); *H01R 13/523* (2013.01); *H01R 24/58* (2013.01);
(Continued)

(58) Field of Classification Search
CPC ..... H01R 13/5205; H01R 13/652; H01R 2103/00; H01R 35/04; H01R 39/64;
(Continued)

(56) References Cited

U.S. PATENT DOCUMENTS 1,492,532 A * 4/1924 Philliips ..... H01R 39/00 439/645
1,743,118 A * 1/1930 Couture ..... H01R 39/64 439/21
(Continued)

FOREIGN PATENT DOCUMENTS

EP 1383205 A1 1/2004
FR 1164127 A 10/1958

OTHER PUBLICATIONS

International Search Report and Written Opinion in related International Application PCT/US2014/024277 mailed Jul. 10, 2014.
(Continued)

*Primary Examiner* — Abdullah Riyami
*Assistant Examiner* — Vladimir Imas
(74) *Attorney, Agent, or Firm* — Abelman, Frayne & Schwab

(57) ABSTRACT

A waterproof swivel electrical cable connector comprises a first housing including a first electrical connector being rotatably connected to a second housing including a second electrical connector. A first elastomeric washer is intermediate the first housing and the second housing and providing a watertight seal between the first housing and the second housing as the first housing and first electrical connector are rotated relative to the second housing and second electrical connector.

18 Claims, 14 Drawing Sheets

Related U.S. Application Data

(60) Provisional application No. 61/788,162, filed on Mar. 15, 2013.

(51) Int. Cl.
*H01R 13/523* (2006.01)
*H01R 24/58* (2011.01)
*H01R 43/16* (2006.01)
*H01R 13/627* (2006.01)

(52) U.S. Cl.
CPC ..... *H01R 39/64* (2013.01); *H01R 43/16* (2013.01); *H01R 13/6275* (2013.01)

(58) Field of Classification Search
CPC ..... H01R 39/643; H01R 13/5219; H01R 13/5202; H01R 13/521; H01R 13/5221; H01R 13/523; H01R 13/5208; H01R 13/59; H01R 13/512; H01R 13/58; H01R 13/5804; H01R 13/502; H01R 13/506; H01R 13/6275; H01R 13/6272; H01R 13/6273; H01R 13/6271
USPC ..... 439/271, 274, 275, 13, 357, 461, 462
See application file for complete search history.

(56) References Cited

U.S. PATENT DOCUMENTS 1,837,890 A * 12/1931 Baker ..... H01R 39/643 439/18
1,977,757 A * 10/1934 Elsas ..... H01R 39/64 439/27
2,098,304 A * 11/1937 Nakich ..... H01R 39/643 439/17
2,387,015 A * 10/1945 Gilbertson ..... H01R 39/64 439/27
2,404,564 A * 7/1946 Boehlke ..... H01R 35/04 285/907
2,476,398 A * 7/1949 Baumann ..... H01R 39/643 439/17
2,545,939 A * 3/1951 Breitenstein ..... H01R 39/643 174/21 JC
2,624,602 A * 1/1953 Dupre ..... H01R 4/50 403/371
2,808,574 A * 10/1957 Kelly ..... H01R 39/64 439/29
2,923,907 A * 2/1960 Buckelew ..... H01R 39/64 439/23
3,234,317 A * 2/1966 Henderson ..... B23K 7/10 174/15.7
4,787,859 A * 11/1988 Heller ..... H01R 13/6271 439/352
4,894,014 A * 1/1990 Palus ..... H01R 39/643 439/17
4,909,741 A * 3/1990 Schasteen ..... E21B 17/028 439/13
5,066,248 A 11/1991 Gaver et al.
5,409,403 A * 4/1995 Falossi ..... H01R 24/38 439/21
5,480,315 A * 1/1996 Martinelli ..... H01R 13/622 439/271
5,803,750 A * 9/1998 Purington ..... H01R 13/6276 439/17
5,984,687 A * 11/1999 Schwarz ..... H01R 39/643 439/17
6,010,348 A * 1/2000 Alden ..... H01R 13/506 439/274
6,071,144 A * 6/2000 Tang ..... H01R 13/52 439/426
6,139,332 A * 10/2000 Tsai ..... H04M 1/02 439/21
6,190,180 B1 * 2/2001 Purington ..... H01R 13/6276 439/17
6,448,494 B1 9/2002 Erlich et al.
6,614,722 B2 9/2003 Polany et al.
6,623,289 B2 * 9/2003 Decicco ..... H01R 13/527 439/271
7,077,699 B2 * 7/2006 Islam ..... H01R 9/0521 439/578
7,566,831 B2 * 7/2009 Holland ..... H01R 13/5219 174/74 R
7,637,744 B2 * 12/2009 Singer ..... H01R 39/643 439/13
7,766,393 B2 * 8/2010 Tiberghien ..... F16L 37/0985 251/149.1
7,819,665 B1 * 10/2010 Nishizawa ..... H01R 24/30 439/13
8,215,962 B1 * 7/2012 Machado ..... H01R 24/58 439/18
8,460,031 B2 * 6/2013 Paynter ..... H01R 9/05 439/584
8,926,336 B2 * 1/2015 Gobel ..... H01R 24/542 439/13
9,203,199 B2 * 12/2015 Brown ..... H01R 39/64
9,300,101 B2 * 3/2016 Hayes ..... H01R 39/64
2004/0077215 A1 * 4/2004 Palinkas ..... H01R 9/0521 439/578
2004/0082218 A1 * 4/2004 Stirling ..... H01R 13/5219 439/587
2008/0286986 A1 * 11/2008 Rashkover ..... B26B 19/44 439/13
2009/0075525 A1 3/2009 Gaidosch
2011/0300730 A1 12/2011 Someya
2011/0312206 A1 12/2011 Seido

OTHER PUBLICATIONS

Extended European Search Report and Written Opinion in related EP Application No. 14769662.9, mailed Oct. 7, 2016.

* cited by examiner

WATERPROOF SEPARABLE SWIVEL CONNECTOR

CROSS-REFERENCE TO RELATED PATENT APPLICATIONS

This patent application claims priority to International Application No. PCT/US2014/024277, filed Mar. 12, 2014 which is a continuation-in-part application of U.S. application Ser. No. 13/965,597, filed Aug. 13, 2013, which claims priority to U.S. Provisional Application No. 61/788,162, filed Mar. 15, 2013, the content of which are incorporated herein by reference in their entireties.

BACKGROUND

There are robotic cleaning vehicles for liquid filled containers that are connected to an electrical power source by a cable. These vehicles often follow tortuous paths of travel in accomplishing their cleaning missions and this results in torsional stress building up in the cables as they twist to accommodate the motion of the vehicles. This torsional stress can be somewhat relieved if segments of the cables rotate with respect to other segments of the same cables. This can be facilitated by inserting swivel joints into the cables. However, such joints need to ensure good electrical contact between the cable segments, isolate the electrical contacts from the liquid in which the vehicles are immersed when in operation and prevent the separation of the cable segments from each other when an axial force is applied to the cable segments. It would also be helpful if the segments of a cable could be readily disconnected from each other at a location between the power source and the vehicle when the vehicle is not in operation. One approach is to effect the electrical connection between the cable segments using a classical stereo jack and socket that has been modified by the placement of an O-ring to isolate the electrical contacts from the immersion liquid. For instance, the socket and the jack can be extended to provide for a groove to accommodate an O-ring in one of them that is distal from the tip of the jack when it is inserted in the socket. Such an arrangement is inadequate to resist the axial forces typically experienced by the cable segments when there is not some other structure to isolate the joint from these axial forces. One such structure is a rigid right angle elbow that encompasses a cable segment but it does not always operate to allow relief of the torsional stress from the movement of the vehicle as efficiently as is desired.

SUMMARY

One embodiment includes a waterproof swivel electrical cable connector comprising a first housing including a first electrical connector being rotatably connected to a second housing including a second electrical connector. A first elastomeric washer is intermediate the first housing and the second housing and providing a watertight seal between the first housing and the second housing as the first housing and first electrical connector are rotated relative to the second housing and second electrical connector.

One embodiment involves a waterproof swiveling electrical cable connector comprising two housings and an elastomeric washer. The first housing has a bore receiving a first cable having a first electrical connector, and a first annular collar. The second housing has a bore receiving a second cable having a second electrical connector, and a second annular collar. The elastomeric washer is immediately adjacent to the first annular collar and the second annular collar. The first housing and second housing are rotatable relative to one another and at least one of the first housing and second housing are rotatable to the elastomeric washer. The first electrical connector is in electrical contact with the second electrical connector such that they maintain electrical contact as they rotate relative to each other. The elastomeric washer provides a watertight seal between the first housing and the second housing as they are rotated relative to one another.

One embodiment involves a water resistant swivel electrical cable connector comprising two housings and an elastomeric washer. The first housing has a cable receiving bore and an electrical connector receiving bore within the cable receiving bore that terminates in a first annular collar. The second housing has a cable receiving bore and an electrical connector receiving bore within the cable receiving bore that terminates in a second annular collar. The elastomeric washer is positioned between the first annular collar and the second annular collar and is immediately adjacent to both. The first housing and second housing are rotatable relative to one another about an axis that passes through both of their cable receiving bores and at least one of the first annular collar and second annular collar is rotatable relative to the elastomeric washer. The elastomeric washer provides a watertight seal between the first housing and the second housing as the first housing and second housing are rotated relative to one another.

One embodiment involves a process of connecting two cable segments to form a water resistant connection that allows the cable segments to rotate relative to each other. A first electrical connector is electrically connected a to a first cable segment and inserted into an electrical connector receiving bore which terminates in a first annular collar and is located within a cable receiving bore of a first housing such that a portion of the electrical connector is adjacent to the first annular collar. The first cable segment is affixed to the first housing in a manner that forms a water resistant seal between them and resists rotational or axial movement between them. A second electrical connector is electrically connected to a second cable segment and inserted into an electrical connector receiving bore which terminates in a second annular collar and is located within a cable receiving bore of a second housing such that a portion of the electrical connector is adjacent to the second annular collar. The second cable segment is affixed to the second housing in a manner that forms a water resistant seal between them and resists rotational or axial movement between them. The first and second annular collars are caused to sandwich an elastomeric washer between them while maintaining a common axis through the cable receiving bores of the first and second housings to create a water resistant seal which is maintained when the first and second housings are rotated relative to each other about the common axis of their cable receiving bores. The first and second electrical connectors are electrically connected such that they maintain electrical connection as they are rotated relative to each other about the common axis of the cable receiving bores of the first and second housings.

One embodiment involves a cable grasping assembly having an end cap with a bore with a decreasing diameter from one end to the other, a cable holding sleeve constructed of a readily compressible material and a housing with an interior bore for accommodating a cable. The end cap has a screw thread on the interior surface of its bore and a ledge that projects inward from the interior surface of the bore adjacent to the end with the smallest diameter. The cable holding sleeve has a generally circular bore which extends over its axial length, a series of ridges which extend radially from its outer surface and which extend axially over a significant portion of its axial length and a collar at one end beyond the axial terminus of the ridges which extends radially from the outer surface of the sleeve. The housing has a series of fingers which extend from one end of the housing with gaps between them to accommodate the ridges of the cable holding sleeve and which have an axial length such that their free ends terminate at the collar of cable holding sleeve and a screw thread on the exterior surface of the housing and spaced from the free end of the fingers.

Another embodiment also involves a waterproof lockable disengaging swiveling electrical cable connector housing structure having a first housing having a cable support structure located within its bore for receiving a first electrical cable segment, a second housing having a cable support structure located within its bore for receiving having a second electrical cable segment and a locking sleeve operatively slidingly secured to the second housing and movable from a first position to a second position to lock the first housing to the second housing, such that the first housing is rotatable relative to the second housing when the locking sleeve is in the locked position.

In other embodiments the structure includes a male housing partially inserted into the bore of a female housing. Each housing has a generally cylindrical body with a cable support structure located within its bore. It also has an interior cylindrical recess to accommodate a cable grasping sleeve, with this recess being located adjacent to the end of the housing distal from the end involved in the partial insertion. Each housing has additionally has an engagement structure for engaging a reciprocal engagement structure on the other housing in such a way that the two housings are free to rotate about the cylindrical surfaces of each other when locked together via their engagement structures and a locking sleeve. It further has a mechanism for affixing an end cap over the exterior surface of the housing which is located adjacent to the end of the housing carrying the recess for a cable sealing sleeve. The structure also includes a sealing structure carried by one of the housings which establishes a water tight seal between the housings when the male is partially inserted into the female and a cable grasping sleeves seated in their recess the housings and constructed of a compressible material. The structure further includes two end caps, each with a mechanism which interacts with the mechanism on one of the housings to affix the end cap to the housing in such a way that the interior diameter of the cable grasping sleeve seated in the housing is decreased and each end cap having an aperture which aligns with the cable support structure located within the bore of its housing. The structure additionally includes a locking sleeve which is manually moveable into and out of interaction with the engagement structures of the two housings such that as a result of the interaction they are locked into engagement and in this locked configuration do not allow axial movement between the two housings.

A further aspect of the embodiments also involves a method of connecting an electrical power cable to a robotic cleaning vehicle for a liquid filled container by providing one electrical cable segment attached to the vehicle and another attached to a power source, equipping the free end of one cable with a classic stereo jack and the free end of the other cable with a classic stereo socket and inserting these free ends into the axially opposed ends of a waterproof lockable disengaging swiveling electrical cable connector housing structure described above such that the jack becomes will become seated in the socket to create two circuit paths when the housing is assembled. The method further involves affixing the end caps of the housing structure on their respective housings such that that housing's cable grasping sleeve grasps the cable segment inserted through its end cap, inserting the male housing into the female housing such that the jack affixed to one cable segment becomes will become seated in the socket affixed to the other cable segment to create two circuit paths and moving the locking sleeve to interact with the engagement structures of the two housings such that the two cable segments are securely held together against any axial force but are free to rotate with respect to each other.

DETAILED DESCRIPTION

Figure 1:
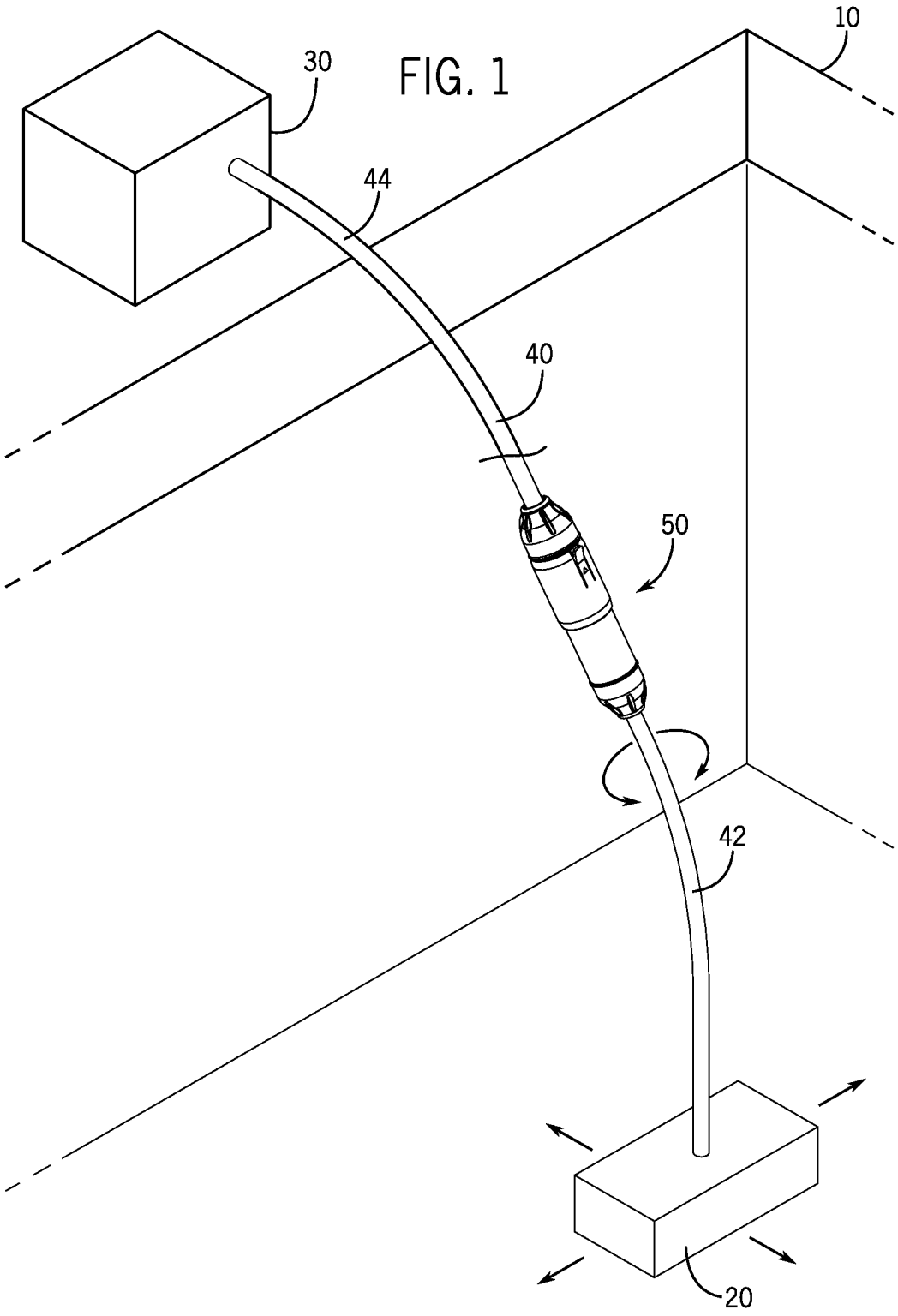
FIG. 1 is an isometric schematic illustration of a liquid containing vessel with a robotic cleaning vessel on its floor connected to an electrical power source via a cable with a swivel connector.

Referring to FIG. 1, the environment of the present invention is illustrated with a liquid containment vessel 10 submerged in which is a robotic cleaning vehicle 20 connected to an electrical power source 30 by an electrical supply cable 40 whose segments 42 and 44 are joined by a cable connector housing structure 50.

Figure 2:
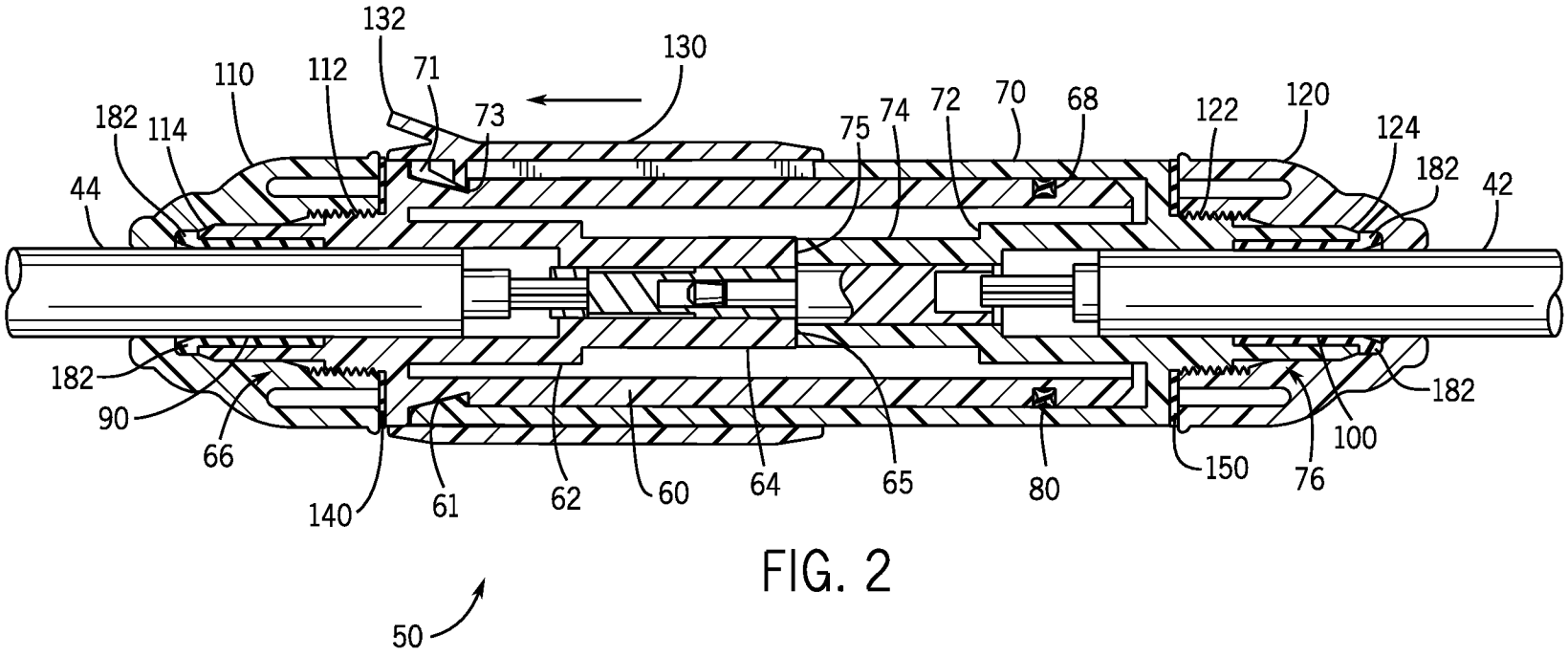
FIG. 2 is a cross section of a locked assembled cable connector housing structure.

Referring to FIG. 2, one embodiment involves a cable connector housing structure 50 which has a male housing 60 which is partially inserted into a female housing 70. The male housing 60 carries a series of detents 61 on its outside surface arranged to provide an unobstructed circular path. In this regard, the series of detents 61 may be a groove as the detents provide an unobstructed circular path about the outside surface of the male housing 60. The female housing 70 carries a series of protuberances 71 which engage the detents or groove 61 thus holding the two housings 60 and 70 together against axial displacement. These protuberances 71 may be conveniently provided by having the interior surface of the open or insertion end of the female housing 70 carry a ridge that is interrupted by the axial slots 77. At least one such axial slot 77 may be needed to allow the radial expansion needed for the protuberances or ridge 71 to pass over the outer surface of the male member 60. Multiple axial slots will facilitate this axial expansion and cause the ridge to be separated into multiple protuberances 71. These protuberances 71 have a sloped rear surface 73 which allows them to be drawn out of the detents or groove 61 upon the application of an axial separating force provided that their ability to move in the radial direction away from the axis of the housings 60 and 70 is not inhibited. The housings 60 and 70 each have a cable support structure 62 and 72, respectively. These structures 62 and 72 serve to support the cable segments 44 and 42, respectively, when the cable segments 44 and 42 are inserted into the housings 60 and 70. The cable support structures 62 and 72 each have an inner bore 64 and 74, respectively, and each of these has an end 65 and 75, respectively. These inner bore ends 65 and 75 are touching thus providing support for the ends of the cable segments 44 and 42. The housings 60 and 70 carry recesses 66 and 76, respectively, which carry cable grasping sleeves 90 and 100, respectively. These sleeves 90 and 100 are constructed of a compressible material and have corrugations about their circumference running in the axial direction to aid in their grasping the cable segments 44 and 42. The male housing 60 carries a groove 68 in which is an O-ring 80 to provide a water tight seal between the two housings 60 and 70. In one embodiment a four-lobed X-ring is used instead of the O-ring. X-rings are commercially available as Quad-Ring® seals. End caps 110 and 120 are threaded on housings 60 and 70 by their female screw threads 112 and 122, respectively. These end caps 110 and 120 have inclined surfaces 114 and 124, respectively, which press against the grasping sleeves 90 and 100, respectively, causing them to firmly grasp the cable segments 44 and 42, respectively. A locking sleeve 130 is in position over the protuberances or ridge 71 preventing them from moving in the radial direction away from the axis of the housings 60 and 70 and being drawn out of the detents or groove 61 by their sloped rear surfaces 73 upon the application of an axial separating force. The locking sleeve 130 is provided with a release tab 132 which facilitates taking it out of engagement with a detent 61 in the male housing 60 when it is desired to move the locking sleeve 130 to an unlocked position. The end caps 110 and 120 seat against rubber washers 140 and 150, respectively.

Figure 3:
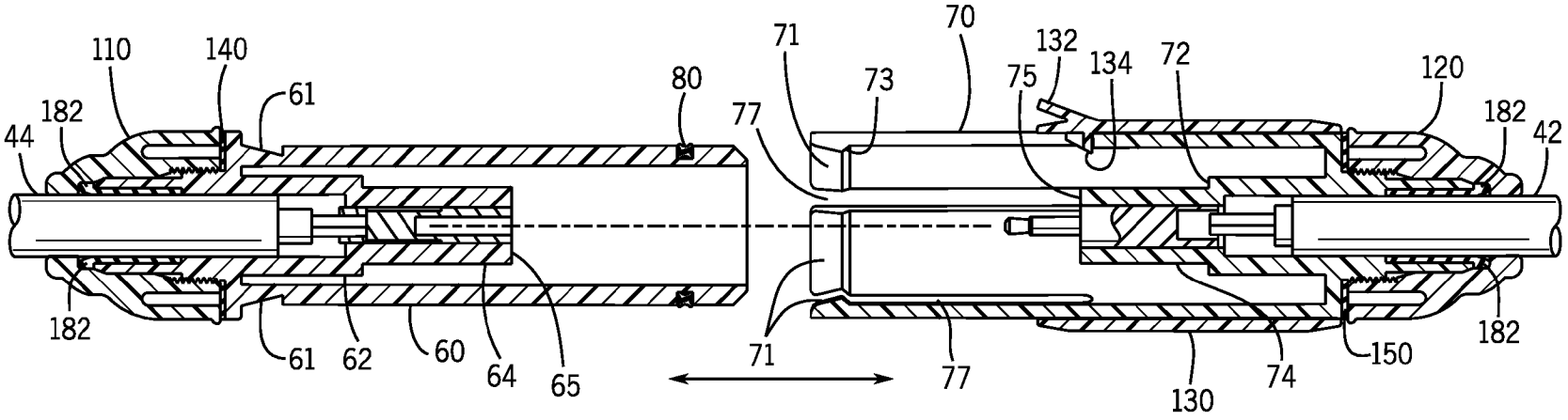
FIG. 3 is a cross section of a disassembled cable connector housing structure.

Referring to FIG. 3, one embodiment involves the two housings 60 and 70 being separated from each other. The locking sleeve 130 is therefore in its unlocked position and the protuberances or ridge 71 of the female housing 70 are not seated in the detents or groove 61 of the male housing 70. The other elements are as they were in FIG. 2 except that the inner bore ends 65 and 75 no longer touch. In one embodiment the outside cylindrical body of the female housing 70 has axial slots 77 which facilitate the radial movement of its protuberances or ridge 71 into and out of engagement with the detents or groove 61 of the male housing 60. One of these slots 77 aligns with the protuberance 134 carried by locking sleeve 130 allowing this protuberance 134 to engage the detents or groove 61 in the male housing 60.

Figure 4:
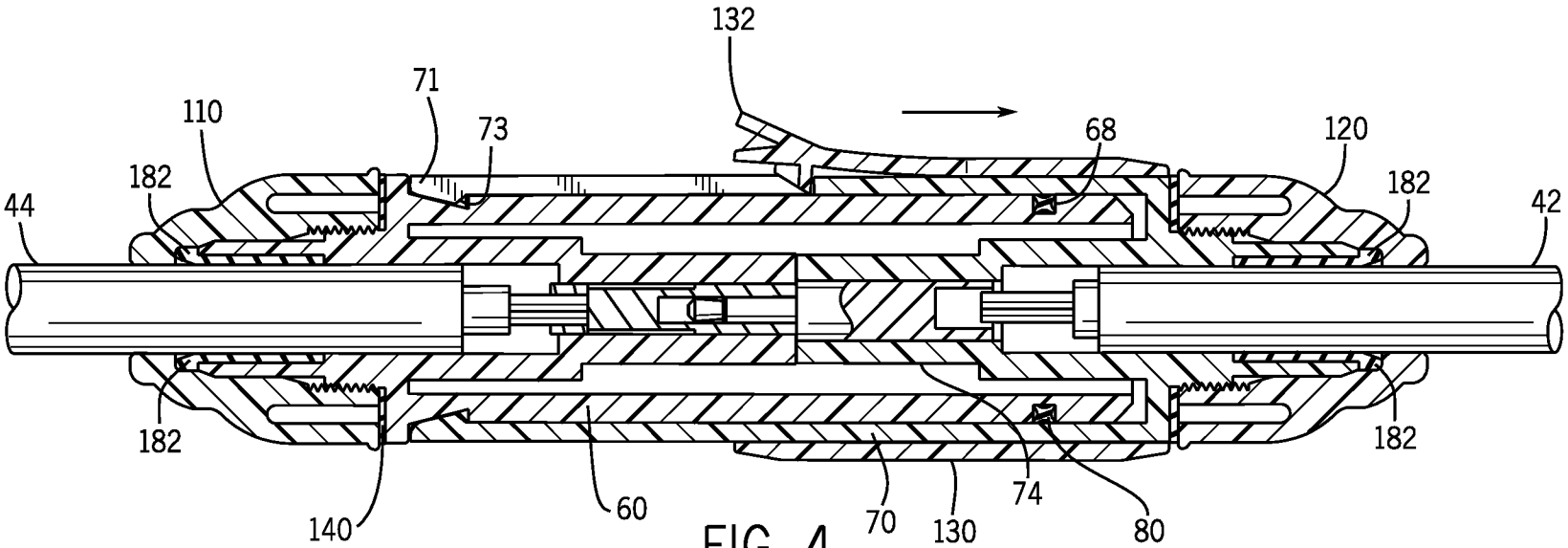
FIG. 4 is a cross section of an unlocked assembled cable connector housing structure.

Referring to FIG. 4, one embodiment involves the male housing 60 partially inserted into the female housing 70, as in FIG. 2 but with the locking sleeve 130 in its unlocked position. This is the configuration intermediate between those shown in FIG. 2 and FIG. 3. It is the configuration just after the male housing 60 is inserted into the female housing 70 or just before the male housing 60 is withdrawn from the female housing 70 by the application of an axial force which draws the protuberances or ridge 71 out of the detents or groove 61 by a sliding and lifting action facilitated by the sloped rear surfaces 73.

Figure 5:
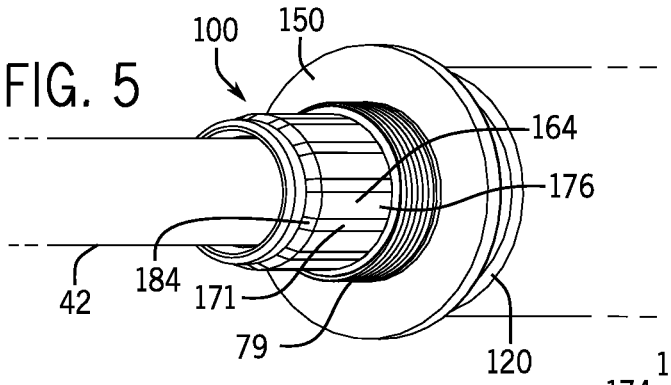
FIG. 5 is an isometric view of grasping fingers on an exterior end of a housing that is a part of a cable connector housing structure.

Referring to FIG. 5, one embodiment involves the female housing 120 equipped with fingers 164 which interact with the ribs 171 of its cable-grasping sleeve 100. The fingers 164 extend outward from the housing's male threads 79. The fingers 164 have outer surface 176. The ribs 171 have an inward taper 184.

Figure 6:
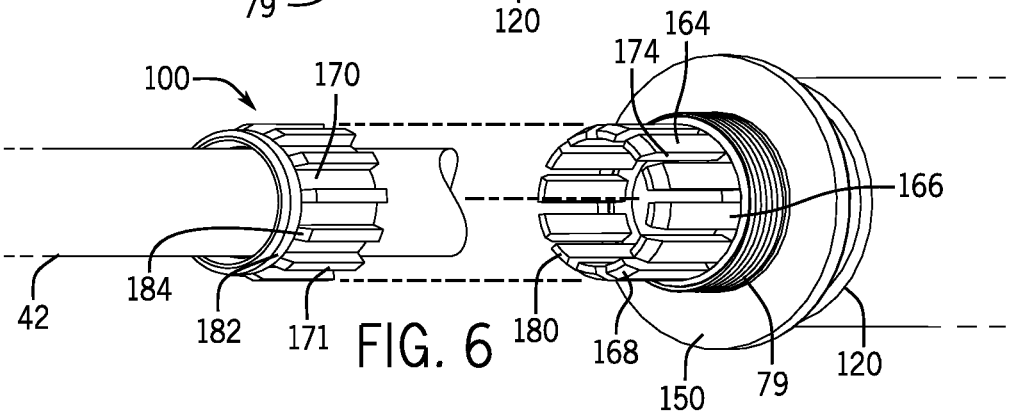
FIG. 6 is an isometric view of grasping fingers on an exterior end of a housing that is a part of a cable connector housing structure and a cable grasping sleeve mounted on a cable segment.

Referring to FIG. 6, this embodiment involves the fingers 164 having a secured end 166 adjacent to the threads 79 and a free end 168 which taper to form a reduced diameter 180. There are gaps 174 between the adjacent fingers 164 to accommodate the ribs 100 of the cable-grasping sleeve 100. The taper 184 of the ribs 171 terminates in a collar 182.

Figure 7:
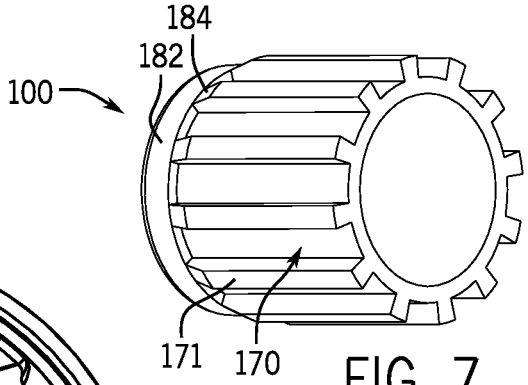
FIG. 7 is an isometric view of the cable grasping sleeve.

Referring to FIG. 7, the collar 182 extends radially outward from the cylindrical surface 170 of the cable-grasping sleeve 100. The diameter of this collar 182 is such that when the fingers 164 of the housing 120 are mated with the cable-grasping sleeve 100, as shown in FIG. 5, there outer surfaces 180 are radially inward of this diameter and their free ends 168 are axially immediately adjacent to this collar 182.

Figure 8:
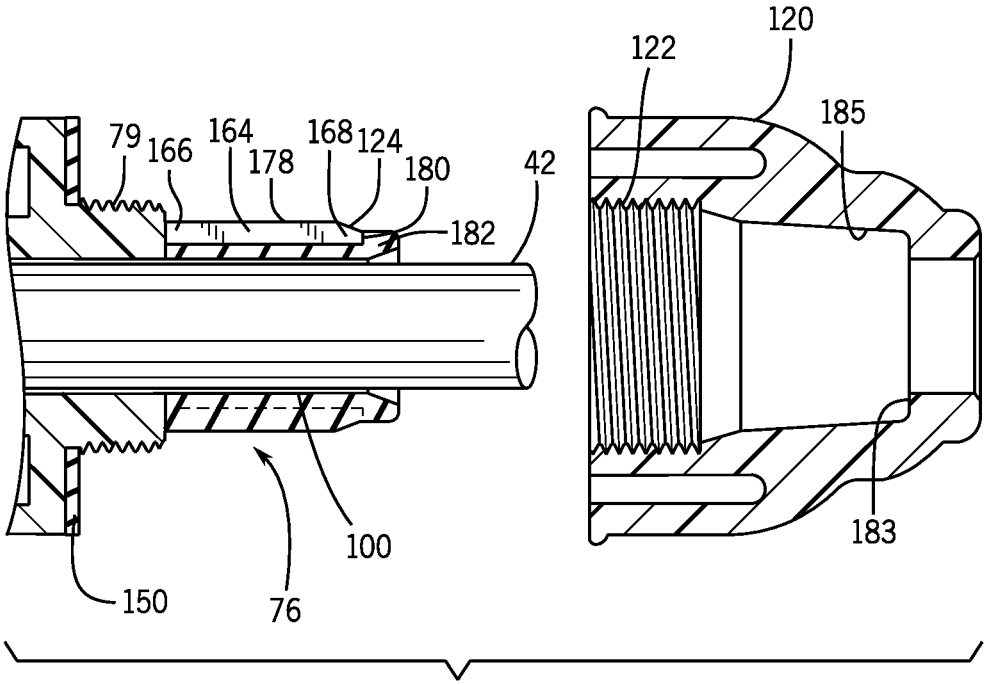
FIG. 8 is a cross section of the exterior end of a housing that is a part of a cable connector housing structure and an end cap adapted to be threaded on this end.
Figure 9:
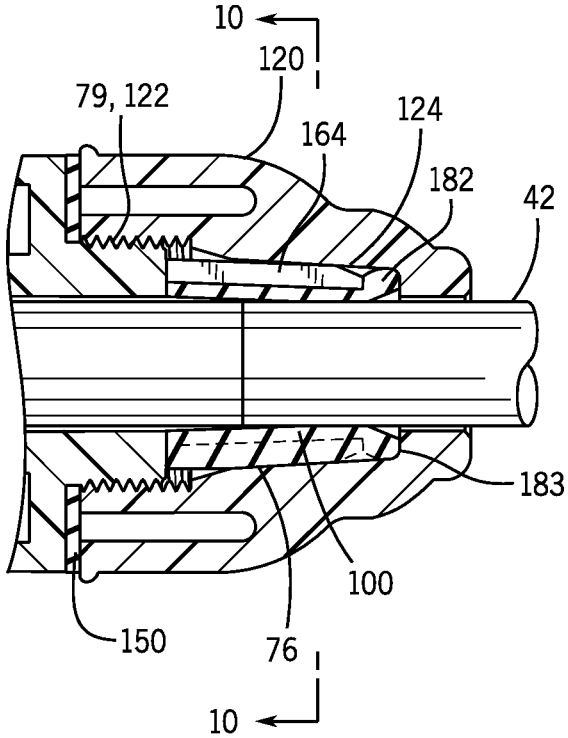
FIG. 9 is a cross section of the exterior end of a housing that is a part of a cable connector housing structure with the end cap threaded onto it.

Referring to FIGS. 8 and 9, one embodiment involves interaction between the end cap 120, the fingers 164 and the cable-grasping sleeve 100 firmly grasp a cable segment 42 and to provide a watertight seal around it. Before the female threads 122 of the end cap 120 engage the male threads 79 of the female housing 70 the outer surface of the fingers 164 define a diameter 178 when not at the taper at the free end 168 where a smaller diameter 180 is defined. The end cap 120 is provided with a collar 183 and a taper 185 on its bore.

Figure 10:
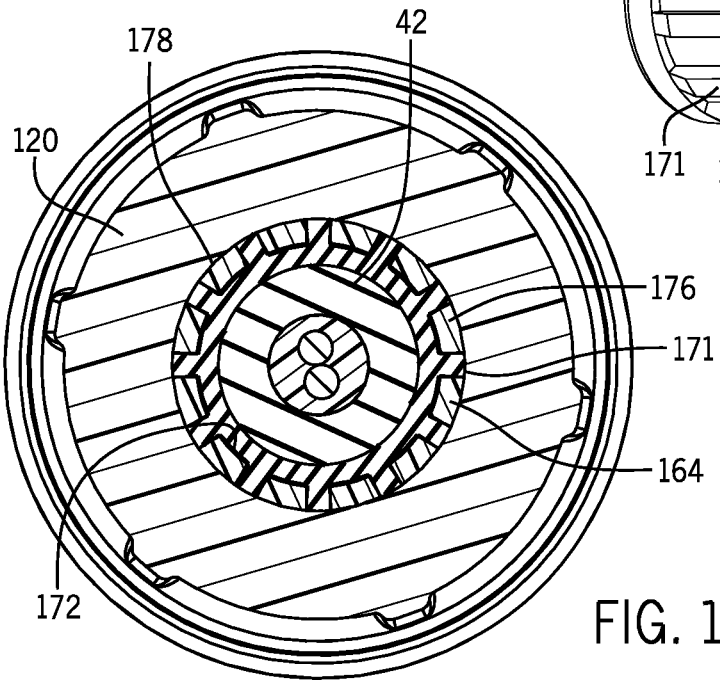
FIG. 10 is a cross section of FIG. 9 along section line 10-10.

When the two threads 79 and 122 fully engage the fingers 164 are levered inward from their secured ends 166 so that their free ends press into the cable-grasping sleeve 100 causing it to firmly grasp the cable segment 42 and its collar 182 to assume an O-ring configuration seated against the ledge 183 of the end cap 120. FIG. 10 is a cross section along line 10-10 of FIG. 9 that also shows the cable grasping assembly engaging the cable segment 42. The outer surfaces 176 of the fingers 164 define a diameter 178 to which the ridges 171 conform.

Figure 11:
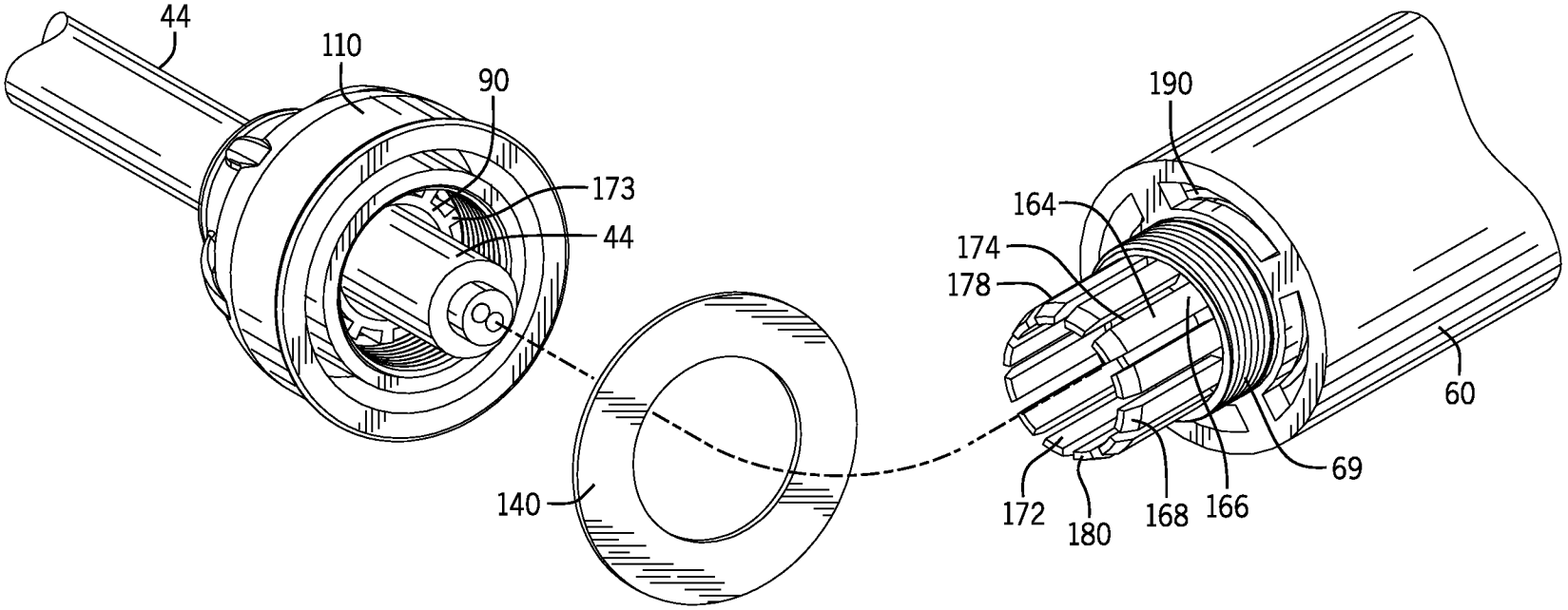
FIG. 11 is an isometric view of the exterior end of a housing that is a part of a cable connector housing structure and an end cap adapted to be threaded on this end.

Referring to FIG. 11, one embodiment involves a cable grasping assembly involving the male housing 60. It has fingers 164 with secured ends 166, free ends 168 and gaps 174. The secured ends 166 project out from the male threads 69 and provide a first diameter 178. The free end 168 provide a second, smaller diameter 180. The housing 60 has molding apertures 190 which facilitate the molding of the housing 60 and are sealed by the rubber washer 140 when the end cap 110 has been secured to the housing 60 by the male threads 69. The fingers 164 define a cavity 172 that accommodates the cable-grasping sleeve 90 with the exception of its ridges 173, which are accommodated by the gaps 174. When secured together the assembly firmly grasps the cable segment 44 and provides a watertight seal around it.

Figure 12:
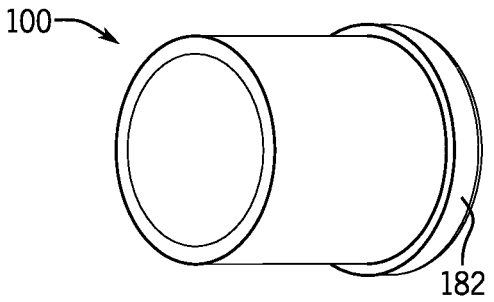
FIG. 12 is an isometric view of an alternative cable grasping sleeve.

Referring to FIG. 12, in one embodiment the female housing cable sleeve 100 has a cylindrical outer surface and a collar 182.

Figure 13:
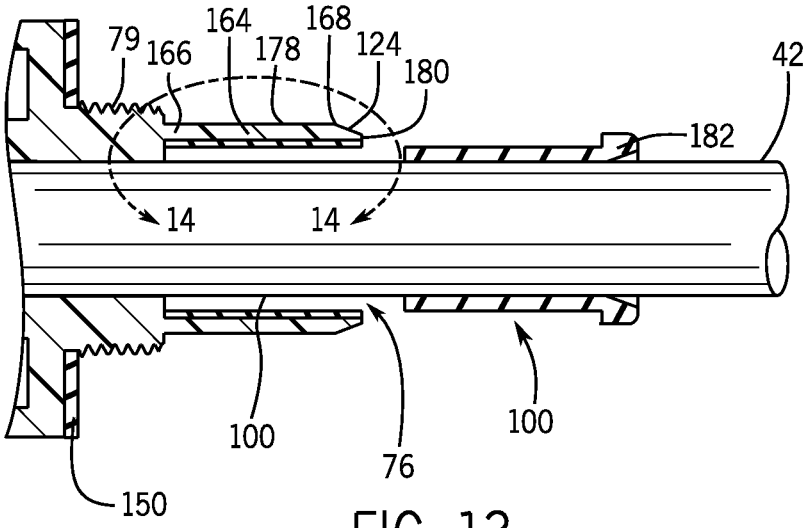
FIG. 13 is a cross section of an alternative exterior end of a housing that is a part of a cable connector housing structure and the alternative cable grasping sleeve.
Figure 14:
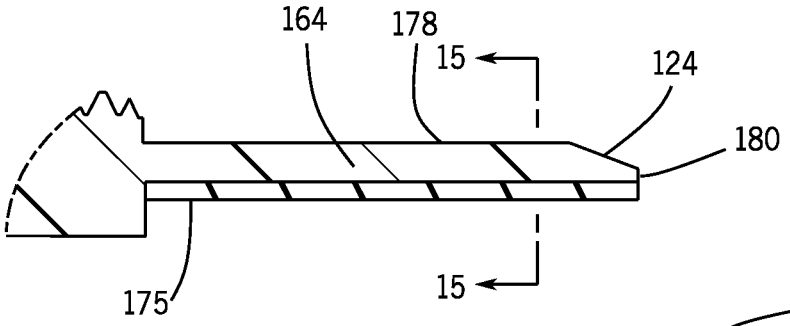
FIG. 14 is an exploded view along line 14-14 of a finger shown in FIG. 13.
Figure 15:
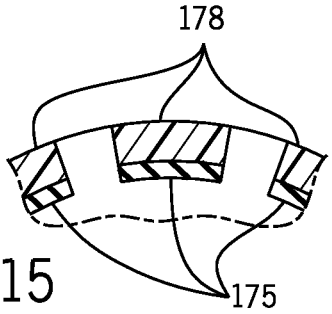
FIG. 15 is a cross section along line 15-15 of FIG. 14.

Referring to FIGS. 13-15, one embodiment involves the fingers 164 having an inner surface 175 especially adapted to interact with the female housing cable sleeve 100 with a cylindrical outer surface. In one embodiment the sleeve 100 and the inner finger surface 175 are both a rubbery material. In one embodiment the sleeve 100 has a very high coefficient of static sliding friction with the inner surface 175 of the fingers 164, similar to that observed between two flat pieces of common rubber.

One embodiment involves constructing the sleeve 100 out of a heat shrinkable material. In this embodiment the sleeve 100 may be secured to the cable segment 42 by the application of heat.

One embodiment involves a composite cable grasping sleeve in which a cylindrical sleeve inner component is initially heat shrunk onto a cable segment and then an outer sleeve component with radial ribs like that illustrated in FIG. 7 is placed over the inner component. Either the inner component or the outer component may carry a collar 182.

In one embodiment, one or more of the elements of the housing structure 50 are fabricated from a thermoplastic material. In one embodiment the thermoplastic material is injection molded to yield one or more of the elements. In one embodiment, the housings 60 and 70, the end caps 110 and 120 and the locking sleeve 130 are fabricated from thermoplastic materials. In one embodiment the cable grasping sleeves 90 and 100 are fabricated from an elastomeric material.

In one embodiment, the housing 50 facilitates connecting cable segments 42 and 44 which run from the robotic cleaning vehicle 20 and the electrical power source 30, respectively, such that the segments 42 and 44 may rotate with respect to each other, with a water tight connection that can be submerged in the liquid in which the vehicle 20 is submerged. In one embodiment, one cable segment is terminated with a classical stereo jack and the other is provided with a classical stereo socket such that when the jack is inserted in the socket two circuit paths two circuit paths are created. These two segments 42 and 44 are inserted through apertures in the end caps 110 and 120 into the cable support structure 62 and 72 of housings 60 and 70, respectively, such that when the inner bore ends 65 and 75 are brought into contact with each other the jack seats within the socket to create two circuit paths. The end caps 110 and 120 are screwed onto their respective housings 60 and 70 and their inclined surfaces 114 and 124, respectively, cause a decrease in the diameter of the cable grasping sleeves 90 and 100 causing them to grasp the cable segments 44 and 42. The male housing 60 is partially inserted into the female housing 70 until the ends 65 and 75 of the inner bores 64 and 75 touch and the protuberances or ridge 71 of the female housing 70 seat in the detents or groove 61 of the male housing 60. The locking sleeve 130 is moved into locking position so that it covers the protuberances or ridge 71 of the female housing 70 and the protuberance which it carries seats in a detent or groove 61 in the male housing 60 through a slot in the female housing 70. The two cable segments 42 and 44 are now securely held together against axial separation force but are free to rotate with respect to each other. In one embodiment, the release tab of the locking sleeve 130 is used to disengage the protuberance of the locking sleeve from its detent 61 in the male housing 60 and the locking sleeve 130 is moved into an unlocked position so it no longer covers the protuberances or ridge 71. An axial separating force is applied which causes the protuberances or ridge 71 of the female housing 70 to be drawn out of the detents or groove 61 of the male housing 60 by their sloped rear surfaces 73 and the male housing 60 is withdrawn from the female housing 70. In this way the two cable segments 42 and 44 are separated from each other and the stereo jack is withdrawn from the stereo socket.

Figure 16:
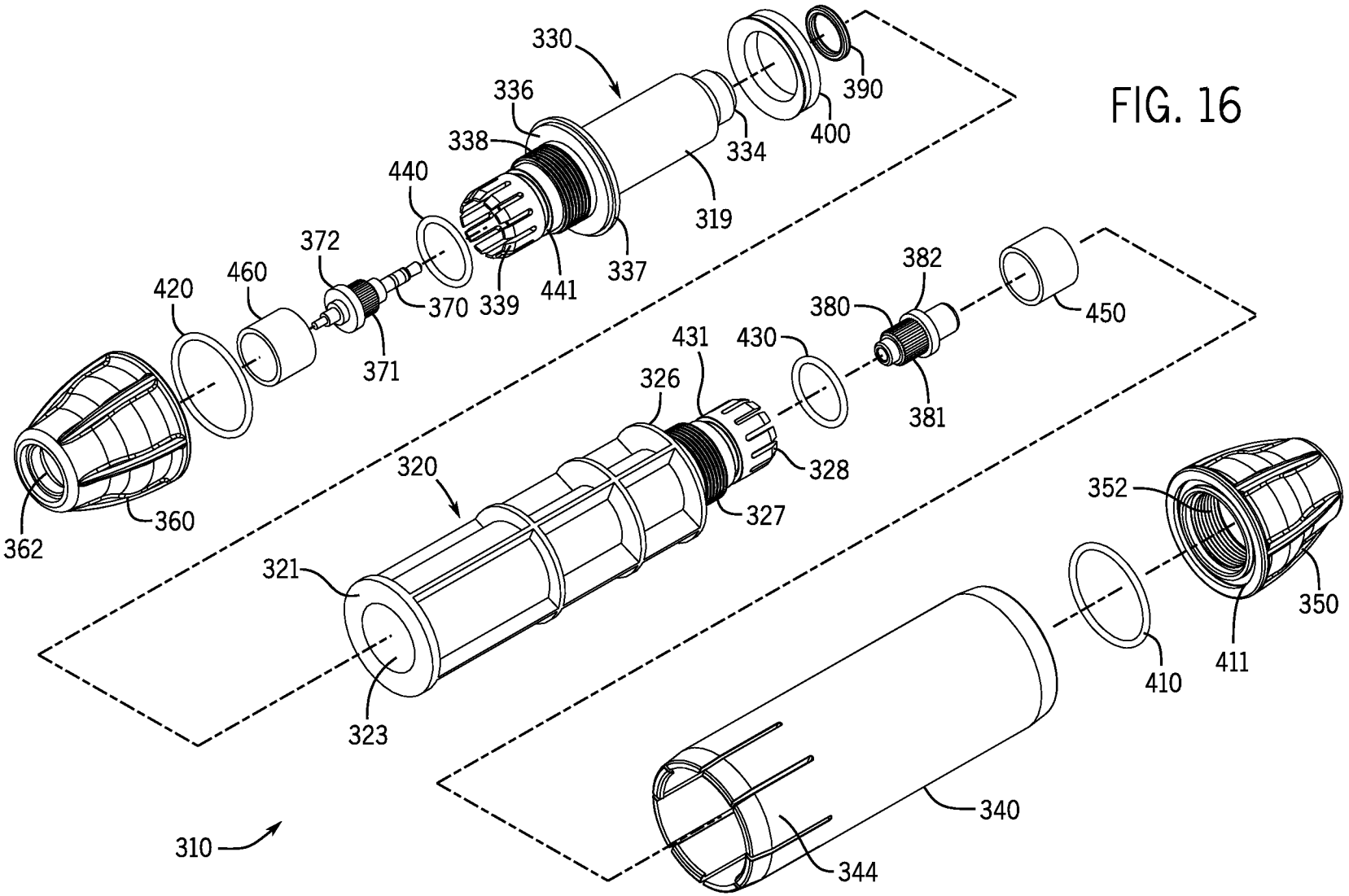
FIG. 16 is an exploded perspective view of an alternative embodiment of a water resistant lockable swiveling electrical cable connector.
Figure 17:
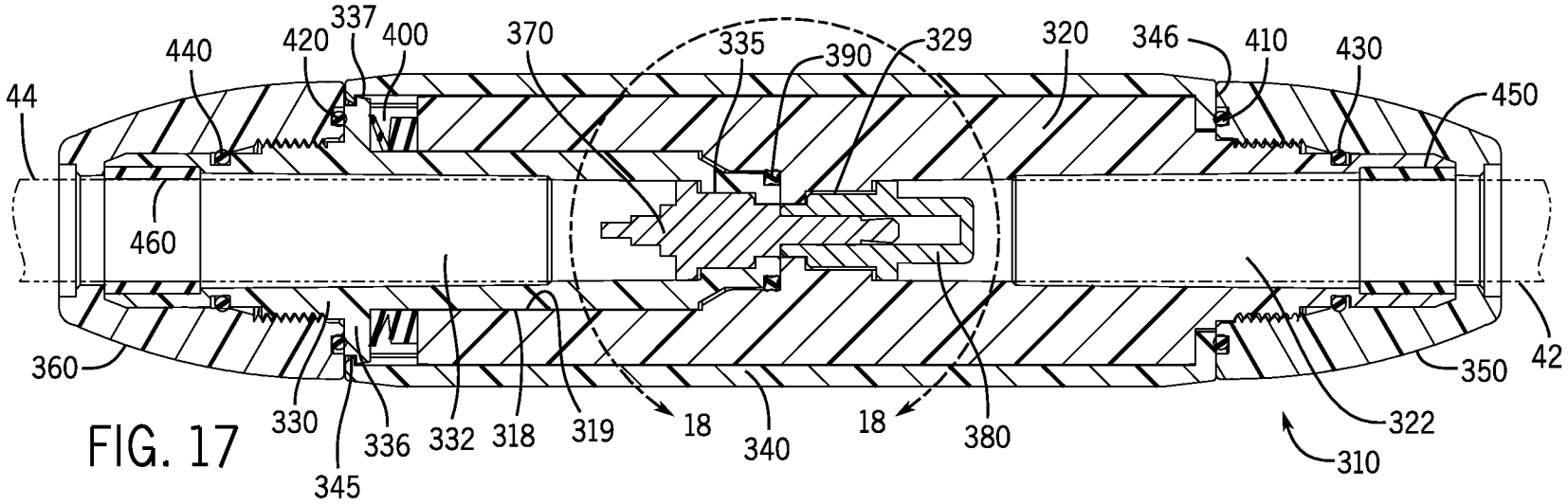
FIG. 17 is a cross section of an assembled version of the electrical cable connector shown in FIG. 16.

Referring to FIG. 16 and FIG. 17, another embodiment of a swivel electric connector 310 includes a first housing 330, a second housing 320, a sleeve or locking sleeve 340 and a first end cap 360 and second end cap 350.

First housing 330 has a first end having a plurality of fingers 339 and an opposing second end. First housing includes an annular collar 334 proximate the second end, a radial collar 336 located intermediate the first end and the second end. Radial collar 336 includes a step 337. An externally threaded portion 338 is adjacent collar 336 between the radial collar 336 and the first end. A plurality of fingers 339 extends from the first end axially toward the threaded region. The threaded portion 338 and fingers 339 cooperate with a cable grasping sleeve 460 and end cap 360 to form a cable grasping structure to firmly hold a first cable that is inserted into a cable bore 362 of the end cap 360 and a cable bore 332 of the first housing 330. First housing 330 has an external surface 319 that is intermediate radial collar 336 and annular collar 334.

An O-ring 420 cooperates with radial collar 336 to provide a water resistant seal when end cap 360 is threaded onto the first housing 330 via threads 338. An O-ring 440 seats in first housing O-ring groove 441 and cooperates with the first housing 330 when end cap 360 is threaded onto the first housing 330 via its threads 338 to provide a water resistant seal. In one embodiment O-rings 420 and 440 may be other types of elastomeric seals known in the art. First housing 330 accommodates a first electrical connector or stereo jack 370 that may have a knurled surface 371 and a radial collar 372 in in a stereo jack insertion bore 335 in a manner described hereinafter.

Referring to FIGS. 16, 17, 22 and 23, second housing 320 has an annular end wall 321 at a first end which surrounds an insertion bore 323. Insertion bore 323 has an internal surface 318. First housing 330 is positioned within bore 323 such that first annular collar 334 is closely adjacent a second annular collar 324 of second housing 320. Second annular collar 324 is positioned within bore 323. Second annular collar 324 is intermediate end wall 321 and a second end axially opposite annular end wall 321. Insertion bore 323 has an inner diameter larger than the outer diameter of first housing 330 to allow for rotation of first housing 330 with respect to second housing 320. Further, once first housing 330 is positioned within the second housing 320 as described below, radial collar 336 of the first housing is proximate annular end wall 321 of the second housing 320.

A V-ring 400 is captured between the radial collar 336 and the annular end wall 321 when first housing 330 is positioned within second housing 320. Second housing 320 includes a step 326 as well as threads 327, O-ring groove 431 and fingers 328. Step 326 is located intermediate annual end wall 321 and threads 327, O-ring groove 431 is located intermediate threads 327 and fingers 328 and the threads 327 are located intermediate step 326, and fingers 328. Second housing 320 also includes protrusions 348 intermediate step 326 and threads 327 that engage detents 347 in locking sleeve annular collar 346. Each finger 328 has a free end proximate the second end of the second housing 320. Fingers 328 cooperate with a cable grasping sleeve 450 and end cap 350 to form a cable grasping structure to firmly hold any cable that is inserted into the cable bore 322 of the second housing 320. End cap 350 includes internal threads 352 that permit end cap 350 to be threadably secured to second housing 320 on threads 327. An O-ring 430 seats in the second housing O-ring groove 431 and cooperates with second housing 320 when end cap 350 is threaded onto the first housing 320 via threads 327 and the end cap's threads 352 to provide a water resistant seal. V-ring 400 and O-ring 430 may each be another type of elastomeric seal known in the art. The second housing 320 accommodates a second electrical connector or stereo jack receptacle 380 that has a knurled surface 381 and a radial collar 382 in stereo receptacle insertion bore 329 a manner described hereinafter.

Figure 26:
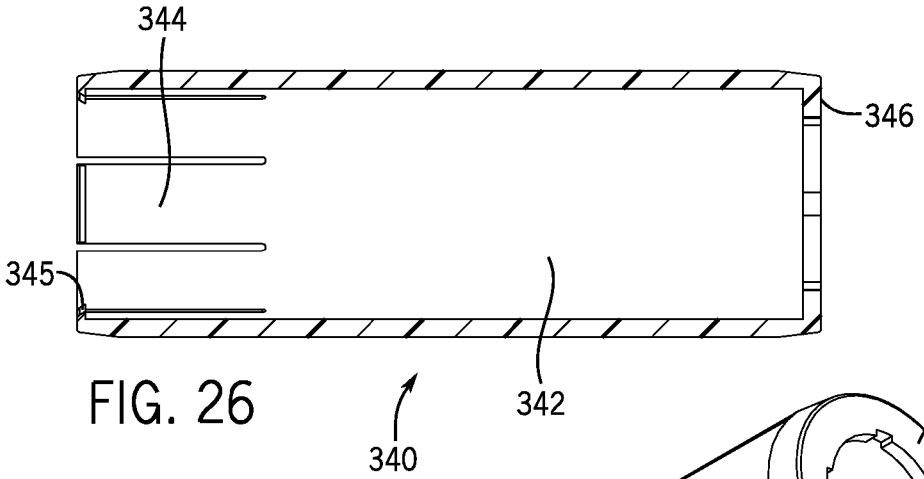
FIG. 26 is a cross section of the locking sleeve of the electrical cable connector shown in FIG. 16.
Figure 27:
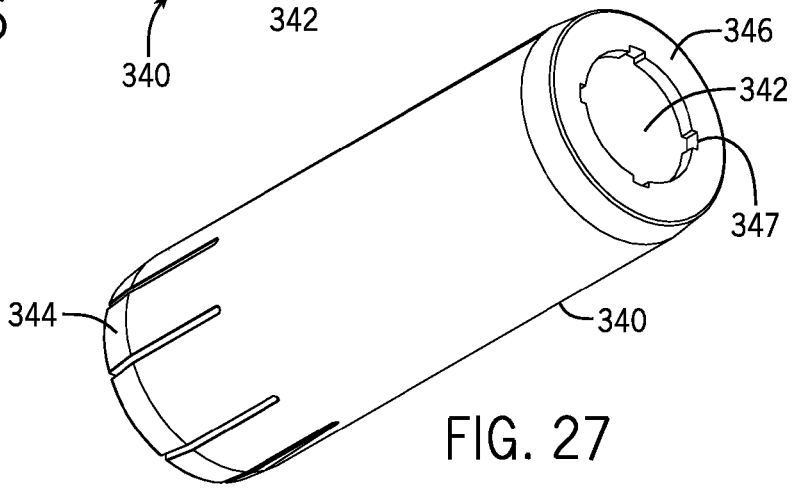
FIG. 27 is a perspective view of the locking sleeve shown in FIG. 26.

A Locking sleeve 340 has fingers 344 that engage step 337 of radial collar 336 when the first housing 330 is partially inserted into the second housing 320 and the second housing 320 is inserted into the locking sleeve 340. Referring to FIGS. 26 and 27 locking sleeve 340 has a bore 342 that accommodates the second housing 320 until the step 326 of the second housing 320 abuts locking sleeve annular collar 346. Locking sleeve annular collar 346 also has detents 347 that engage second housing protrusions 348. O-ring 410 seats in second housing end cap O-ring groove 411 and cooperates with end cap 350 and locking sleeve annular collar 346 to form a water resistant seal when end cap 350 is threaded onto the first housing 320 via its threads 327 and the end cap's threads 352. O-ring 410 may be another type of elastomeric seal known in the art.

Figure 18A:
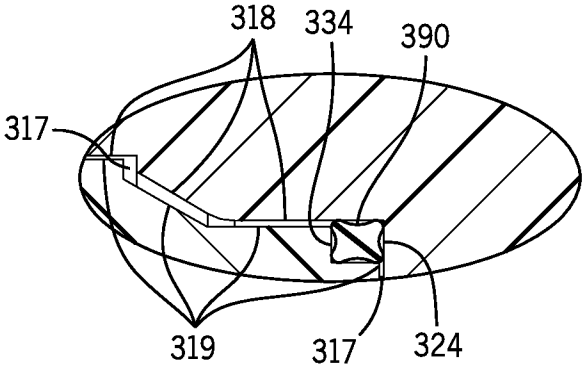
FIG. 18A is a detail view of a portion of FIG. 18
Figure 18:
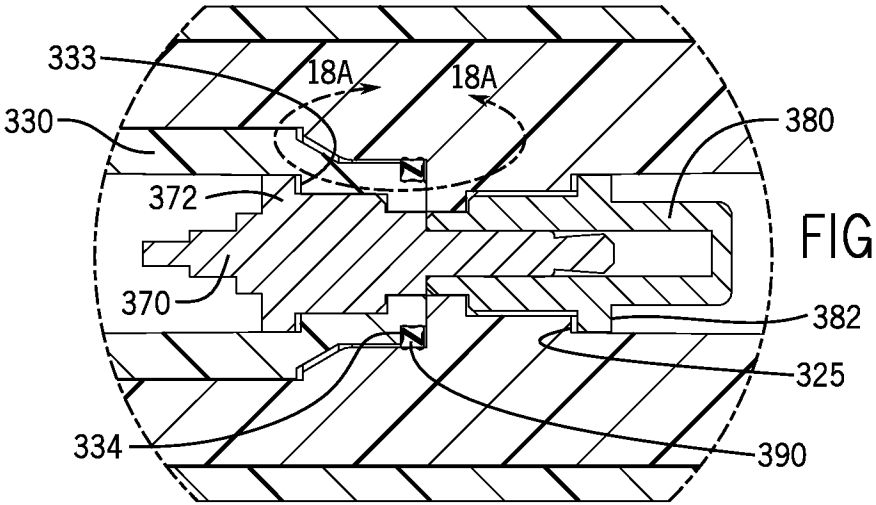
FIG. 18 is a detail view of a portion of FIG. 17.

Referring to FIGS. 17, 18 and 18A an O-ring 390 is captured between annular collar 334 of first housing 330 and annular collar 324 of second housing 320. The O-ring is captured proximate the regions which carry the first electrical connector 370 and the second electrical connector 380, respectively, in a manner described in more detail hereinafter when the first housing 330 and the second housing 320 are urged together by the locking sleeve 340. O-ring 390 is so dimensioned that it maintains a clearance 317 between the second housing inner surface 318 and the first housing outer surface 319 as well as between second housing annular collar 324 and first housing annular collar 334. Clearance 317 facilitates freedom of rotation between the first housing 330 and second housing 320. O-ring 390 may be another type of elastomeric seal known in the art. The first electrical connector or stereo jack 370 and the second electrical connector or stereo jack receptor 380 provide two independent conductive paths in a manner well known in the art and illustrated in FIGS. 27-28 of U.S. Pat. No. 6,412,133. The disclosure of this patent is incorporated herein by reference. As described more fully hereinafter first electrical connector and second electrical connector rotate relative to one another as first housing 330 and second housing 320 rotate relative to one another. In this manner an electrical connection is maintained as the first housing 330 and second housing 320 rotate relative to one another.

Cable grasping sleeves 450 and 460 are shown as independent elements. However, they could also be features of the two cables to be joined by the cable connector. For instance, they could be elastomeric sleeves which have heat shrunk or adhesively affixed onto the cables or they could otherwise be a part of the outer structure of the cables which provides elastomeric surfaces which interact with the fingers 329 and 339 to provide a water resistant seal and resist axial movement of the cables independent of the first and second housings.

Referring to FIG. 17, in one embodiment locking sleeve 340 urges first housing 330 toward second housing 320 by the engagement of the protuberances 345 of its fingers 344 with the first housing radial collar step 337 and by the engagement of the locking sleeve annular collar 346 with the second housing step 326. The locking sleeve 340 is so dimensioned that when so engaged it exerts an axial force on O-ring 390 and V-ring 400. Under this axial load the O-ring 390 and the V-ring 400 each provide a water resistant seal that is sustained if the first housing 330 is rotated relative to the second housing 320 about their common axis.

First housing cable bore 332 ends in a stereo jack insertion bore 335. Stereo jack knurled surface 371 is positioned within bore 335 to hold the stereo jack 370 in place and coaxial to the axis of the cable connector. In a similar manner, the second housing 320 has a stereo receptacle insertion bore 329 at the end of cable bore 322. Stereo receptacle knurled surface 381 is positioned within bore 329 to hold the stereo receptacle 380 in place and coaxial to the axis of the cable connector. In an alternative embodiment stereo receptacle 380 may be retained by the first housing 330 and the stereo jack 370 retained by the second housing 320. Also the stereo jack and its receptacle could readily be replaced by any connector set which provides two independent conduction paths and is able to maintain these conduction paths when the two elements of the set are rotated relative to each other. One such approach is disclosed in European Patent No. 1,383,205, which is incorporated herein by reference.

Referring to FIG. 18, one embodiment first housing cable bore 332 includes a step 333 which defines the start of its stereo jack insertion bore 335. The stereo jack radial collar 372 seats against step 333 when the stereo jack 370 is inserted into the first housing stereo jack insertion bore 335. In a similar manner the second housing cable bore 322 includes a step 325 that defines the start of its stereo receptacle insertion bore 329. The stereo receptacle radial collar 382 seats against this step 325 when the stereo receptacle 380 is inserted into the second housing stereo receptacle insertion bore 329.

Figure 20:
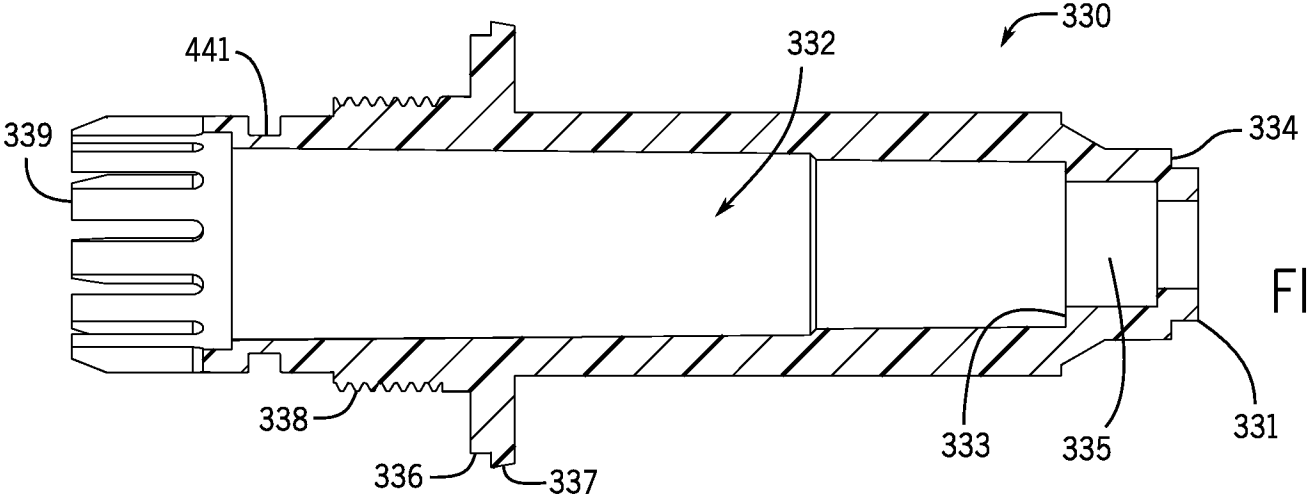
FIG. 20 is a cross section of the first housing of the electrical cable connector shown in FIG. 16.
Figure 21:
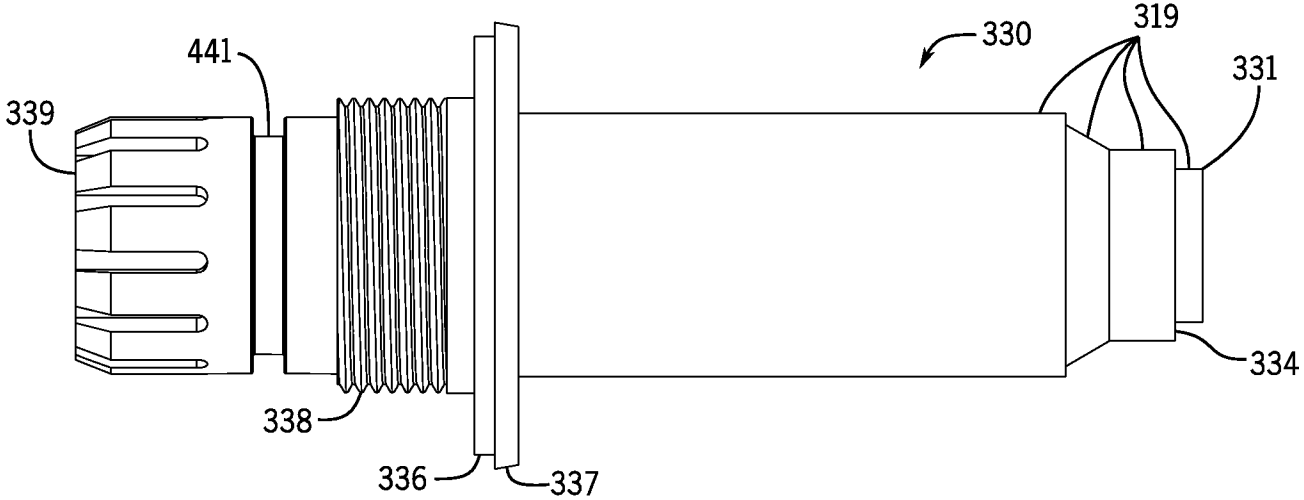
FIG. 21 is a side elevation view of the first housing shown in FIG. 20.

Referring to FIGS. 20 and 21, one embodiment of the first housing 330 involves a cable bore 332, an annular collar 334, a stereo jack insertion bore 335, a radial collar 336 which carries a step 337, threads 338 and fingers 339. Referring to FIGS. 16-18 annular collar 334 is configured to interact with the O-ring 390. Integral with collar 334 is a first housing extension 331 that serves to hold the O-ring 390 coaxial with the axis of the cable connector 310.

Figure 22:
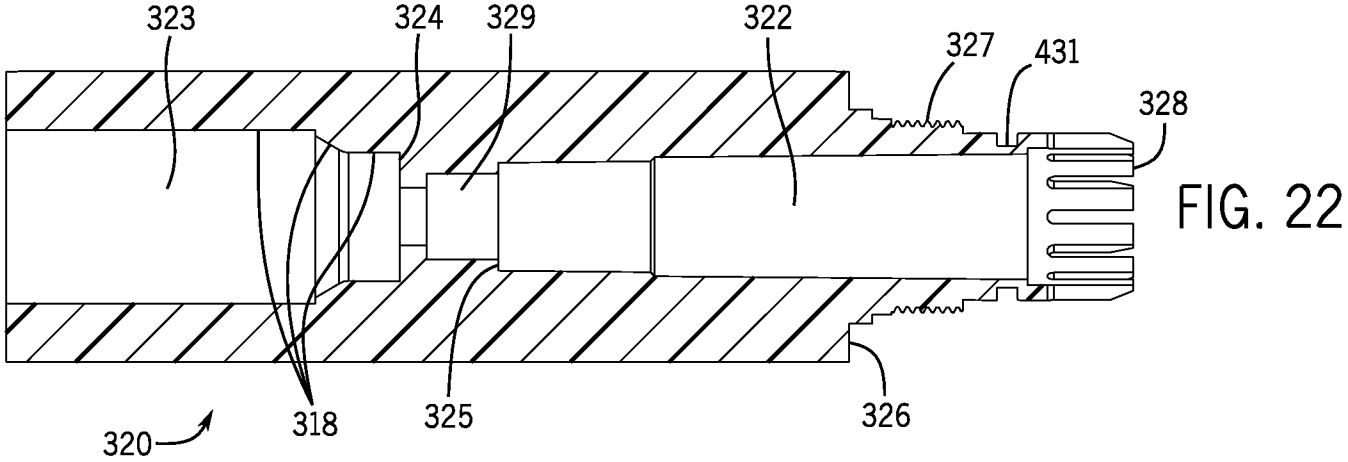
FIG. 22 is a cross section of the second housing of the electrical cable connector shown in FIG. 16.
Figure 23:
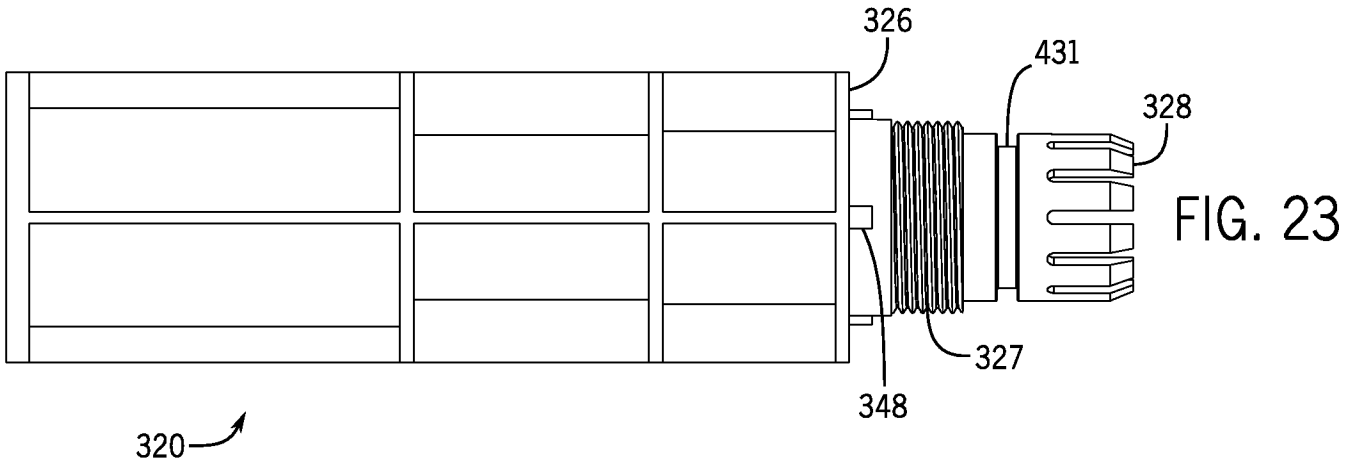
FIG. 23 is a side elevation view of the second housing shown in FIG. 22.

Referring to FIGS. 22 and 23, one embodiment of the second housing 320 involves a cable bore 322, an insertion bore 323, an annular collar 324, a cable bore step 325, a second housing step 326, threads 327, fingers 328 and stereo receptacle insertion bore 229. Referring to FIGS. 20 and 21 second housing annular collar 324 interacts with the first housing annular collar 334 to capture the annular collars O-ring 390 and apply an axial force to it when the cable connector 310 is assembled with its locking sleeve 340. Referring to FIGS. 17 and 26-27 step 326 interacts with the locking sleeve annular collar 346 to limit the axial travel of the locking collar 340.

Figure 24:
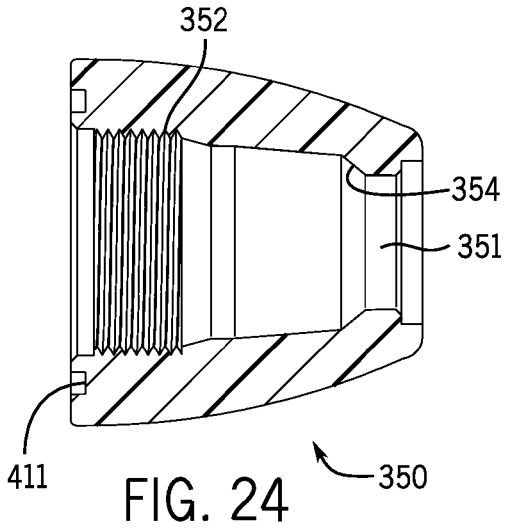
FIG. 24 right hand or second housing end cap of the electrical cable connector shown in FIG. 16.
Figure 25:
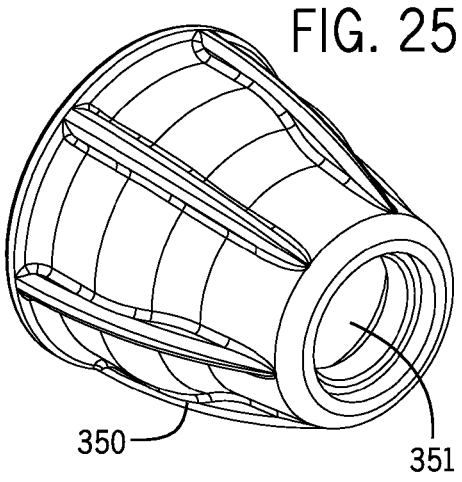
FIG. 25 is a perspective view of the end cap shown in FIG. 24.

Referring to FIGS. 24 and 25, one embodiment of the second housing end cap 350 involves a cable bore 351, internal threads 352 and a sloped surface 354. The sloped surface 354 is designed to interact with the second housing fingers 328 and to cause fingers 328 to move radially inward when the end cap 350 is threaded on the second housing 320 via threads 327 and 352. This radially inward movement exerts pressure on the second housing cable grasping sleeve 450. If a cable is present in the second housing cable bore 322, the result is that the cable resists axial movement independent of the second housing 320 and that a water resistant seal is formed about the periphery of the cable. A similar effect is obtained by the interaction between the first housing end cap 360, which also has a sloping surface (not shown), and the first housing fingers 339. End caps 350 and 360 have essentially the same structure so only the internal structure of end cap 350 has been shown.

Referring to FIGS. 26 and 27, one embodiment of the locking sleeve 340 includes a locking sleeve bore 342, locking sleeve fingers 344 which carry protuberances 345 and a locking sleeve annular collar 346. The locking sleeve protuberances 345 interact with the first housing radial collar step 347 to secure the locking sleeve 340 against axial movement when the sleeve 340 has been placed in a locking position. The locking sleeve 340 is so dimensioned that when it is in position with its annular collar 346 abutting the second housing step 326 and its finger protuberances 345 engaging the first housing radial collar step 337, it exerts an axial force urging the first housing 330 against the both O-ring 390 and V-ring 400 and consequentially the second housing 320.

The cable connector 310 may be conveniently used to join two cable segments 42 and 44 by soldering the two conductors of one of the cable segments to the two conductive leads of the stereo jack 370 and the two conductors of the other cable segment to the two conductive leads of stereo jack receptacle 380. Stereo jack 370 and its attached cable segment are then threaded through end cap 360 by passing it through its cable bore 362, O-ring 420, first housing cable grasping sleeve 460 and O-ring 440 and then it is inserted into first housing 330 past first housing teeth 339 into first housing cable bore 332 until stereo jack radial collar 372 is proximate first housing cable bore step 333. This involves force fitting stereo jack knurled surface 371 into the stereo jack insertion bore 335. O-ring 420 may conveniently be seated on the end cap 360 and O-ring 440 may be seated in first housing O-ring groove 441 before the threading. Sleeve 460 may already be in place inside teeth 339, though it may be more convenient to thread the cable segment through teeth 339 before seating sleeve 460 in teeth 339. Then first housing end cap 360 is threaded onto first housing threads 338 until a water resistant seal is created between first housing end cap 360 and first housing radial collar 336 by exerting an axial force on O-ring 420. This action also creates a water resistant seal between O-ring 440 and end cap 360 and forces the fingers 339 into sleeve 460 to create a water resistant seal and a grasping force that resists axial movement between the cable segment and first housing 330.

The stereo receptacle 380 and the corresponding attached cable segment are threaded through end cap 350 by passing it through its cable bore 351, O-ring 410, locking sleeve bore 342, second housing cable grasping sleeve 450 and O-ring 430 and then it is inserted into second housing 320 past second housing teeth 328 into second housing cable bore 322 until stereo receptacle collar 382 is proximate second housing cable bore step 325. This involves force fitting stereo jack receptacle knurled surface 381 into stereo receptacle insertion bore 329. O-ring 410 may be conveniently seated in second housing O-ring groove 411 and O-ring 430 may be conveniently seated in second housing O-ring groove 431 before the threading. Sleeve 450 may already be in place inside teeth 328, though it may be more convenient to thread through teeth 328 before seating sleeve 450 in teeth 328.

Locking sleeve 340 may be placed over second housing 320 until locking sleeve annular collar 346 contacts second housing step 326 at which point locking sleeve radial slots 347 will have engaged second housing radial projections 348. The slots 347 and the projections 348 are dimensioned to frictionally engage each other. The locking sleeve 340 may be in place over second housing 320 when stereo receptacle 380 and its attached cable segment are inserted into second housing 320 or it may be moved into position over second housing 320 after the stereo receptacle 380 and its attached cable segment are passed through locking sleeve bore 342.

Then second housing cap 350 is threaded onto second housing threads 327 until it establishes a water resistant seal between itself and locking sleeve annular collar 346 by exerting an axial force on O-ring 410. This action also creates a water resistant seal between O-ring 430 and end cap 350 and forces fingers 328 into sleeve 450 to create a water resistant seal and a grasping force that resists axial movement between the cable segment and second housing 320.

The first housing 330 and second housing 320 may now be joined to create a secure water resistant swivelable connection between cable segments 42 and 44. V-ring 400 is placed over male housing outer surface 319 and adjacent to first housing radial collar 336 and O-ring 390 is placed on first housing extension 331. This may also be done before stereo jack 370 is inserted into first housing 330. First housing 330 may be inserted into the second housing insertion bore 323 until O-ring 390 contacts second housing annular collar 324 and the V-ring 400 contacts the second housing annular end wall 321. Further axial pressure may be exerted to force locking sleeve protuberances 345 over first housing radial collar step 337. Locking sleeve 340 is dimensioned such that when protuberances 345 have engaged step 337 an axial pressure is exerted urging first housing 330 toward second housing 320 and compressing O-ring 390 and V-ring 400 so that each creates a water resistant seal.

Figure 19:
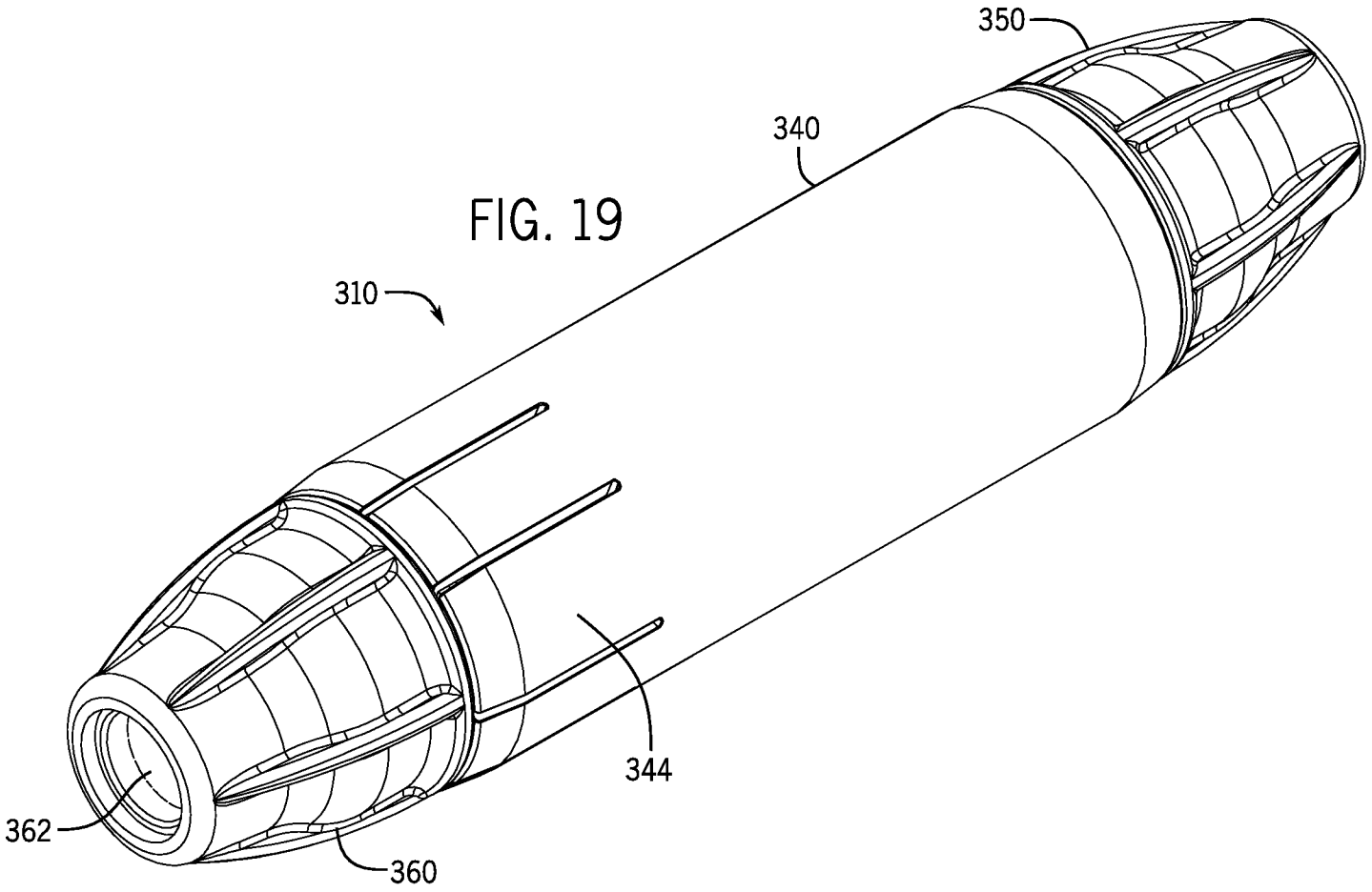
FIG. 19 is a perspective view of the electrical cable connector shown in FIG. 17.

The assembled cable connector 310 is shown in FIG. 19 in one embodiment without the cable segments 42 and 44 extending from the end caps 350 and 360. With the cable connector 310 joining two cable segments cable segment 44 extends out of first housing cable bore 332 and cable segment 42 extends out of second housing cable bore 322. Once the cable connector 310 is fully assembled first housing 330, cable 44 and stereo jack 370 may rotate relative to second housing 320, cable 42 and stereo jack receptacle 380 while maintaining electrical connection between cable 42 and cable 44 in a water resistant/water proof environment.

The cable connector 310 may be conveniently constructed from a wide variety of materials readily apparent to those skilled in the art. It is particularly convenient if all the components other than the stereo jack and stereo receptacle are constructed from materials which are particularly poor conductors of electricity such as typical polymers used in engineering construction. It is also convenient if the weight of the cable connector is minimized and the engineering polymers such as the polyacetals are helpful in this regard. From a fabrication point of view, it is convenient if the cable connector is fabricated of injection moldable materials. It is convenient if certain of the components are constructed of materials with properties particularly suited to their functions. For instance, it is helpful if the O-rings and V-ring are fabricated from elastomeric materials with appropriate Shore hardnesses for sealants and the fingers are constructed of materials able to undergo elastic deformation sufficient to undergo the deformations encountered in assembling the cable connector 310. It is convenient if the locking sleeve 340 is constructed of a material that not only undergoes elastic deformation but also exerts a sufficient return force to assure sealing of the annular collars O-Ring 390 and the V-ring 400 when the locking collar 340 is in a locked position, i.e. the cable connector 310 is fully assembled. It is also convenient if the cable grasping sleeves 450 and 460 are constructed of an elastomeric material with sufficient compressibility to conform to the outer surface of typical power cables for robotic pool cleaners and the sloping surfaces 354 of and end cap 350. It is also helpful if they have a high coefficient of friction. Rubber and rubber like polymers such as nitrile rubbers with a 50 to 55 durometer have a suitable combination of these properties.

While only certain features of the invention have been illustrated and described herein, many modifications and changes will occur to those skilled in the art. It is, therefore, to be understood that the appended claims are intended to cover all such modifications and changes as fall within the true spirit of the invention. A number of features are disclosed herein. These features may combined in multiple combinations such that features may be used alone or in any combination with any of the other features.

What is claimed is:

1. A waterproof swivel electrical cable connector comprising:

a first housing including a first electrical connector being rotatably connected to a second housing including a second electrical connector; the first housing including a first bore extending therethrough from a first end to an opposing second end, the first end of the first housing configured to receive a first end of a first electrical cable, a first annular collar proximate the second end of the first housing, and a radial collar extending outwardly from an outer surface of the first housing; the second housing including a second bore extending therethrough from a first end to an opposing second end, the first end of the second housing configured to receive a first end of a second electrical cable, the second bore at the opposing second end configured to receive the second end of the first housing, an annular end wall provided at the second end of the second housing, and a second annular collar located intermediate the first and second ends of the second housing;

a first elastomeric washer intermediate the first housing and the second housing and immediately adjacent to the first annular collar and the second annular collar to provide a watertight seal between the first housing and the second housing as the first housing and first electrical connector are rotated relative to the second housing and second electrical connector; and a second elastomeric washer captured between the radial collar of the first housing and the annular end wall of the second housing and forming a water resistant seal there between and simultaneously allowing the first housing to rotate relative to the second housing.

2. The waterproof swivel electrical cable connector of claim 1 further including a cable grasping assembly operatively securing a portion of the first electrical cable to the first housing and prohibiting axial and rotational movement of the first electrical cable with respect to the first housing, wherein a force applied to the first electrical cable does not transmit a force to the first electrical connector relative to the first housing.

3. The waterproof swivel electrical cable connector of claim 1 further including a cable grasping assembly operatively securing a portion of the second electrical cable to the second housing and prohibiting axial and rotational movement of the second electrical cable with respect to the second housing, wherein a force applied to the second electrical cable does not transmit a force to the second electrical connector relative to the second housing.

4. The waterproof swivel electrical cable connector of claim 1, further including a sleeve operatively coupling the first housing to the second housing and biasing the first housing and second housing into engagement with the second elastomeric washer.

5. The waterproof swivel electrical cable connector of claim 1, further including a sleeve which urges the first annular collar and the second annular collar into contact with the first elastomeric washer, the sleeve having a bore with a diameter larger than at least a portion of an outer diameter of the first housing and at least a portion of an outer diameter for the second housing, the sleeve having a first end with a sleeve annular collar operatively engaged with a step on the exterior of the second housing intermediate the first end of the second housing and the second end of the second housing, the sleeve having a second end opposite the first end, the sleeve including at least one finger extending radially inward from the second end operatively engaging the radial collar on the first housing when the at least one finger is moved over the radial collar.

6. The waterproof swivel electrical cable connector of claim 1, further including a first end cap and a second end cap, each end cap having a cap bore extending there through, the cap bore having a first threaded region adjacent a first end of the end cap and a second sloping region having a diameter that tapers from the threaded region toward a second end of the end cap, a first cable holding sleeve and a second holding sleeve, each of the first cable holding sleeve and second holding sleeve being constructed of a compressible material;

the first housing having a plurality of circumferentially distributed fingers extending from the first end of the first housing;

the second housing having a plurality of circumferentially distributed fingers extending from the first end of the second housing;

each of the first housing and second housing having a threaded region on an exterior surface of the respective housing, the fingers of each housing being forced radially inward into an exterior surface of the respective cable holding sleeve by the sloping surface of the cap bore as the threaded region of the end cap is threadably coupled to the threaded region of the housing.

7. The waterproof swivel electrical cable connector of claim 6, wherein the fingers of each housing are defined by a series of slots which are spaced about the circumference of first end of the housing.

8. The waterproof swivel electrical cable connector of claim 6, wherein each housing carries a washer on a respective outside surface of the housing between the respective fingers and the respective threaded region.

9. The waterproof swivel electrical cable connector of claim 1, further comprising:

an electrical power source that is electrically connected to the first electrical cable; and a robotic cleaning vehicle for cleaning a liquid filled container that is electrically connected to a second end of the second electrical cable.

10. The waterproof swivel electrical cable connector of claim 6, wherein the fingers include a surface that slopes radially inwardly.

11. The waterproof swivel electrical cable connector of claim 1, wherein the first elastomeric washer captured between the first annular collar and the second annular collar is an O-ring.

12. The waterproof swivel electrical cable connector of claim 1, wherein the first electrical connector is one of a stereo jack and a stereo jack receptacle, and the second electrical connector is the other of the stereo jack and stereo jack receptacle.

13. A water resistant swivel electrical cable connector comprising:

a first housing having a first end with a first cable receiving bore therethrough and a second end with a first electrical connector receiving bore therethrough, the cable receiving bore in communication with the electrical connector receiving bore, a first annular collar proximate the second end of the first housing, and a radial collar extending outward from an outer surface of the first housing;

a second housing having a first end with a second cable receiving bore therethrough, and a second end with a second electrical connector receiving bore having a second annular collar, the second end having an opening receiving the second end of the first housing, the second annular collar being located intermediate the first end of the second housing and the second end of the second housing, and an annular end wall adjacent the second end of the second housing;

a first elastomeric washer positioned between the first annular collar and the second annular collar and immediately adjacent to both;

the radial collar of the first housing being closely adjacent the annular end wall of the second housing when the first housing is partially inserted into the second housing;

the first housing and second housing being rotatable relative to one another about an axis that passes through both of their cable receiving bores and at least one of the first annular collar and second annular collar being rotatable relative to the elastomeric washer;

the first elastomeric washer providing a watertight seal between the first housing and the second housing as the first housing and second housing are rotated relative to one another; and a second elastomeric washer is captured between the radial collar of the first housing and the annular end wall of the second housing forming a water resistant seal there between and simultaneously allowing the first housing to rotate relative to the second housing.

14. A water resistant swivel electrical cable connector comprising:

a first housing having a cable receiving bore and an electrical connector receiving bore within the cable receiving bore having a first annular collar;

a second housing having a cable receiving bore and an electrical connector receiving bore having a second annular collar;

a first elastomeric washer positioned between the first annular collar and the second annular collar and immediately adjacent to both;

the first housing and second housing being rotatable relative to one another about an axis that passes through both of their cable receiving bores and at least one of the first annular collar and second annular collar being rotatable relative to the elastomeric washer;

the first elastomeric washer providing a watertight seal between the first housing and the second housing as the first housing and second housing are rotated relative to one another;

a first end cap and a second end cap, each end cap having a bore extending there through, the bore having a first threaded region adjacent a first end of the end cap and a second sloping region having a diameter that tapers from the threaded region toward a second end of the end cap, a first cable holding sleeve and a second holding sleeve, each of the first cable holding sleeve and second holding sleeve being constructed of a compressible material;

the first housing having a plurality of circumferentially distributed fingers extending from the first end of the first housing;

the second housing having a plurality of circumferentially distributed fingers extending from the first end of the second housing; and each of the first housing and second housing having a threaded region on an exterior surface of the respective housing, the fingers of each housing being forced radially inward into an exterior surface of the respective cable holding sleeve by the sloping surface of the bore as the threaded region of the end cap is threadably coupled to the threaded region of the housing.

15. A process of connecting two cable segments to form a water resistant connection that allows the cable segments to rotate relative to each other comprising:

electrically connecting a first electrical connector to a first cable segment and inserting the electrical connector into an electrical connector receiving bore which terminates in a first annular collar and is located within a cable receiving bore of a first housing such that a portion of the electrical connector is adjacent to the first annular collar;

affixing the first cable segment to the first housing in a manner that forms a water resistant seal between them and resists rotational or axial movement between them;

electrically connecting a second electrical connector to a second cable segment and inserting the electrical connector into an electrical connector receiving bore which terminates in a second annular collar and is located within a cable receiving bore of a second housing such that a portion of the electrical connector is adjacent to the second annular collar;

affixing the second cable segment to the second housing in a manner that forms a water resistant seal between them and resists rotational or axial movement between them;

causing the first and second annular collars to sandwich an elastomeric washer between them while maintaining a common axis through the cable receiving bores of the first and second housings to create a water resistant seal which is maintained when the first and second housings are rotated relative to each other about the common axis of their cable receiving bores; and electrically connecting the first and second electrical connectors such that they maintain electrical connection as they are rotated relative to each other about the common axis of the cable receiving bores of the first and second housings, wherein the affixing of the first and second cable segment steps comprises: providing the first housing and the second housing each with a cable grasping structure at its cable receiving end which comprises: an end cap with a bore open at either end with a decreasing diameter from one end to the other with: a screw thread on the interior surface of the bore of the end cap having the greatest diameter; the surface of the interior of the bore adjacent to the end with the smallest diameter sloping inward towards that end; a cable holding sleeve that is a hollow cylinder constructed of a readily compressible material; a series of circumferentially distributed fingers which extend from the end of the housing forming a part of the cable grasping structure; and a screw thread on the exterior surface of the housing and spaced from the free end of the fingers; and threading each end cap onto it respective housing so as to force the fingers radially inward into the cable holding sleeve by the sloping surface of the bore of the end cap to thereby secure the respective first and second electrical cable segments within the first and second housings.

16. The process of claim 15, wherein the end of the first housing that is axially opposite its cable receiving end is partially inserted into the second housing through an open end that is at the axially opposite end of the second housing from its cable receiving end;

the first housing carries a radial collar extending outward from its outer surface that completely covers the open end of the second housing when the first housing is partially inserted into the second housing; and the elastomeric washer is captured between the radial collar of the first housing and the annular end wall of the open end of the second housing to form a water resistant seal but allow the first housing to rotate about its bore with respect to the second housing.

17. The process of claim 15, wherein the first electrical connector is one of a stereo jack and a stereo jack receptacle, and the second electrical connector is the other of the stereo jack and stereo jack receptacle.

18. The waterproof swivel electrical cable connector of claim 1, wherein the second elastomeric washer between the radial collar and the annular end wall is a V-ring.

* * * * *